US006264540B1

(12) United States Patent
Fruitman

(10) Patent No.: US 6,264,540 B1
(45) Date of Patent: Jul. 24, 2001

(54) METHOD AND APPARATUS FOR DISPOSABLE BLADDER CARRIER ASSEMBLY

(75) Inventor: Clinton O. Fruitman, Chandler, AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/539,279

(22) Filed: Mar. 30, 2000

(51) Int. Cl.[7] ..... B24B 5/00; B24B 47/02
(52) U.S. Cl. ..... 451/398; 451/288
(58) Field of Search ..... 451/41, 63, 56, 451/285, 287, 288, 364, 398, 443

(56) References Cited

U.S. PATENT DOCUMENTS 5,449,316 * 9/1995 Strasbaugh ..... 451/289
6,019,670 * 2/2000 Cheng et al. ..... 451/443
6,019,671 * 2/2000 Shendon ..... 451/398
6,077,155 * 6/2000 Hayakawa et al. ..... 451/443

* cited by examiner

*Primary Examiner*—Derris H. Banks
(74) *Attorney, Agent, or Firm*—Snell & Wilmer, L.L.P.

(57) ABSTRACT

A bladder carrier assembly having a retaining ring permanently bonded to a bladder to form a one-piece disposable bladder assembly. The retaining ring includes a rigid ring member, preferably steel, and a layer of wear resistant material, such as ultra high molecular weight polyethylene or polyether ethyl ketone, which is molded around predetermined portions of the rigid ring member. The bladder is also molded to the retaining ring and an optional template may be molded to a surface of the bladder which lies adjacent a wafer to be polished.

21 Claims, 6 Drawing Sheets

METHOD AND APPARATUS FOR DISPOSABLE BLADDER CARRIER ASSEMBLY

FIELD OF THE INVENTION

The present invention relates generally to a disposable bladder carrier assembly for retaining workpieces such as semiconductor wafers. More particularly, the present invention relates to a one piece disposable bladder carrier assembly where a rubber bladder is molded directly to a retaining ring having a rigid ring surrounded by a bonded wear resistant plastic such as polyether ethyl ketone (PEEK) or ultra-high molecular weight polyethylene (UHMW) polyethylene. The rubber bladder is permanently bonded to the rigid ring and may also be bonded to the wear resistant plastic depending upon the particular embodiment of the bladder carrier assembly.

BACKGROUND OF THE INVENTION

Presently known chemical mechanical polishing machines typically employ either a single carrier or a plurality of carriers, each configured to hold a single semiconductor wafer firmly against a polishing surface, for example the upper surface of a rotating polishing pad. As a result of the relative motion between the semiconductor wafer surface to be polished and the polishing pad, coupled with the downward pressure applied by the wafer carrier to press the wafer against the polishing pad, even very small deviations in the uniformity of the pressure applied to the semiconductor wafer across the wafer surface can result in imperfections in the planarization process. In order to maintain a uniform pressure to the semiconductor wafer, current carriers often comprise a flexible membrane, or bladder, that covers a downward opening on the underside of a carrier thereby creating a space between the carrier and the bladder. An idealized bladder system expands or translates primarily in the axis of the wafer. When a pressurized fluid is applied to the space, the bladder applies a uniform downward pressure across the entire upper surface of a wafer that is being polished. One example of such a carrier can be found in U.S. Pat. No. 5,449,316 issued to Strasbaugh.

Although current carriers employing a bladder enable uniformity, carrier to carrier identicalness is a problem. Further, current carrier designs employing a bladder have a high cost of ownership due to several factors relating to lifetime of the carrier and replacement costs of the carrier such as downtime, wear on the retaining ring, ring delamination, part fatigue, assembly reproducibility and difficulty in assembling the carriers. In addition, current carriers employ adhesives and/or compressive joints which can fail as a result of too much pressure and vacuum cycling in a wet corrosive environment.

Accordingly, there is a need for a reliable bladder carrier that is cost efficient and time efficient. There is also a need for a method for making such a bladder carrier that further reduces cost of ownership.

SUMMARY OF THE INVENTION

In general, in one aspect, the invention relates to a one-piece bladder carrier assembly having a bladder that is permanently bonded to a retaining ring structure for retaining workpieces during processing. The bladder carrier assembly includes a rigid ring, preferably comprised of steel, a wear resistant material, such as ultra-high molecular weight (UHMW polyethylene, PEEK, polyetherketone, polyphenylene sulfide, polybutylene terthalate, and homopolymer acetal, which is formed around the rigid ring, and a bladder that is permanently bonded to the steel after or when it is cast. In another aspect of the invention, the bladder may also be permanently bonded to the wear resistant material. In addition, a cavity may be formed either within the wear resistant material, or within both the wear resistant material and the rigid ring to create a pressure wave relief space.

In general, in another aspect, the invention relates to a method for making a one-piece bladder carrier assembly. A rigid ring having bore holes is made and then mounted on a hardened steel plate. This assembly is then placed in a mold and a wear resistant material, such as UHMW polyethylene or PEEK, is formed around, and bonded to, the rigid ring by employing increased temperature and pressure. A bladder material such as EPDM rubber is molded concurrently with the ring structure such that the bladder is permanently bonded to either the rigid ring, or both the wear resistant material and the rigid ring. In another aspect of the invention, the bladder may be molded to the ring structure in a second step subsequent to the formation of the ring structure.

A main advantage of the invention is a reduced cost of ownership due to an increase in the lifetime of the carrier and a decrease in replacement costs. A further cost ownership advantage is the time and simplicity of part change procedures in a simple, one piece bolt up type assembly.

BRIEF DESCRIPTION OF THE DRAWINGS

The accompanying drawings, which are incorporated in and constitute a part of the specification, schematically illustrate the invention, and together with the general description given above and the detailed description given below, serve to explain the principles of the invention. In the following Figures, like reference numbers refer to similar elements throughout the Figures.

DETAILED DESCRIPTION OF EXEMPLARY EMBODIMENTS

The present invention is directed to a one-piece, disposable bladder-retaining ring assembly (also known throughout the specification and claims herein as a disposable bladder carrier assembly) for use in chemical mechanical polishing (CMP) of workpieces that has a built in low cost of ownership. The bladder-retaining ring assembly is designed to extend the lifetime of a carrier and as a result, can process many more wafers than current carrier designs. When the bladder-retaining ring assembly has completed its useful lifetime, the assembly is simply thrown away and replaced with another one-piece bladder-retaining ring assembly.

Figure 1:
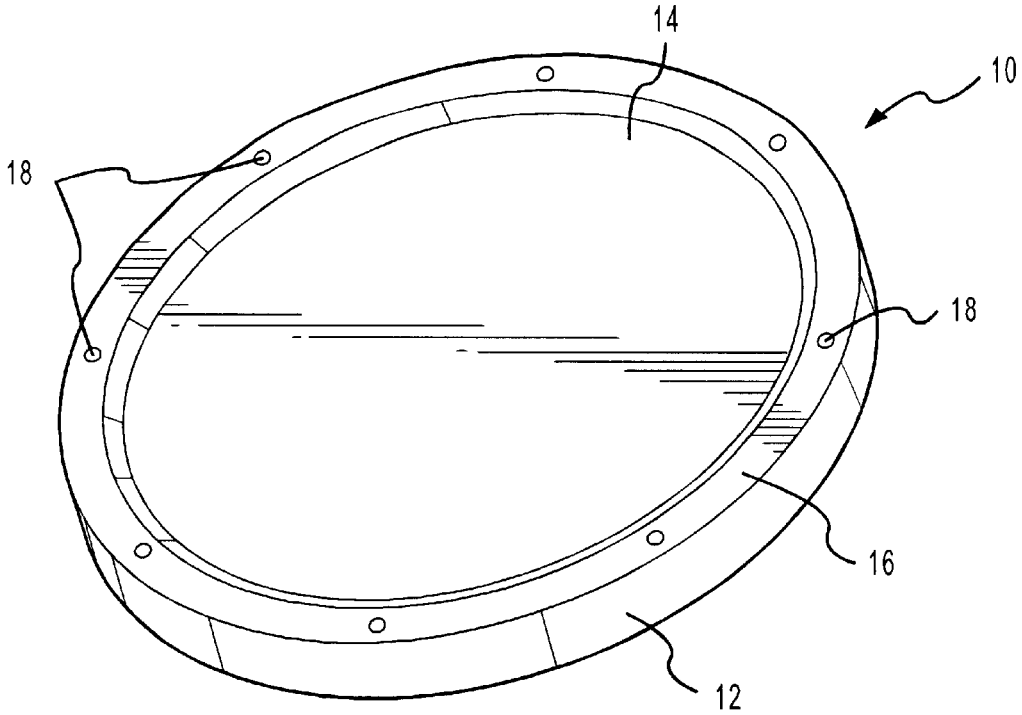
FIG. 1 is a perspective view of the backside of the bladder carrier assembly of the present invention shown from the top of the assembly.
Figure 2:
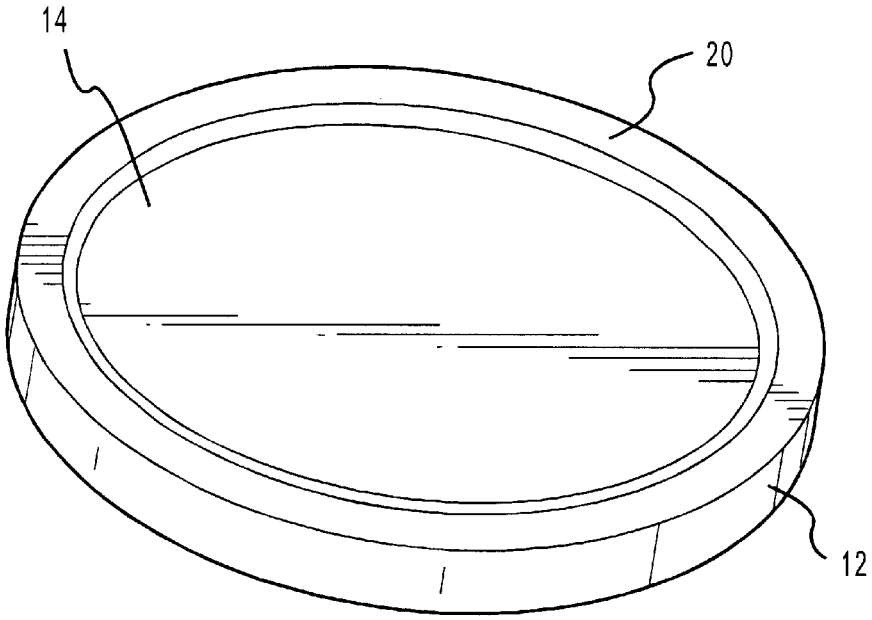
FIG. 2 is a perspective view of the front or wafer side of the bladder carrier assembly of the present invention shown from the bottom of the assembly.

FIG. 1 is a perspective view of the disposable bladder carrier assembly 10 shown from the top of the assembly which is known as the backside of the assembly during use. The disposable bladder carrier assembly includes a retaining ring assembly 12 that is permanently bonded to a bladder 14. A top surface 16 of retaining ring assembly 12 has a plurality of bore holes 18 which extend into retaining ring assembly 12 to enable the disposable bladder carrier assembly 10 to be secured to a CMP apparatus. The carrier retains a wafer while the CMP apparatus rotates and moves the wafer across a polishing surface. Another perspective view of the disposable bladder carrier assembly 10 shown from the bottom of the assembly which is known as the front or wafer retaining side of the assembly during use is shown in FIG. 2. The bladder 14 is permanently bonded to the retaining ring assembly 12 near a bottom surface 20 of the bladder carrier assembly 10. It is this side of the bladder carrier assembly 10 which retains a recessed wafer and comes into contact with a polishing surface.

Figure 3A:
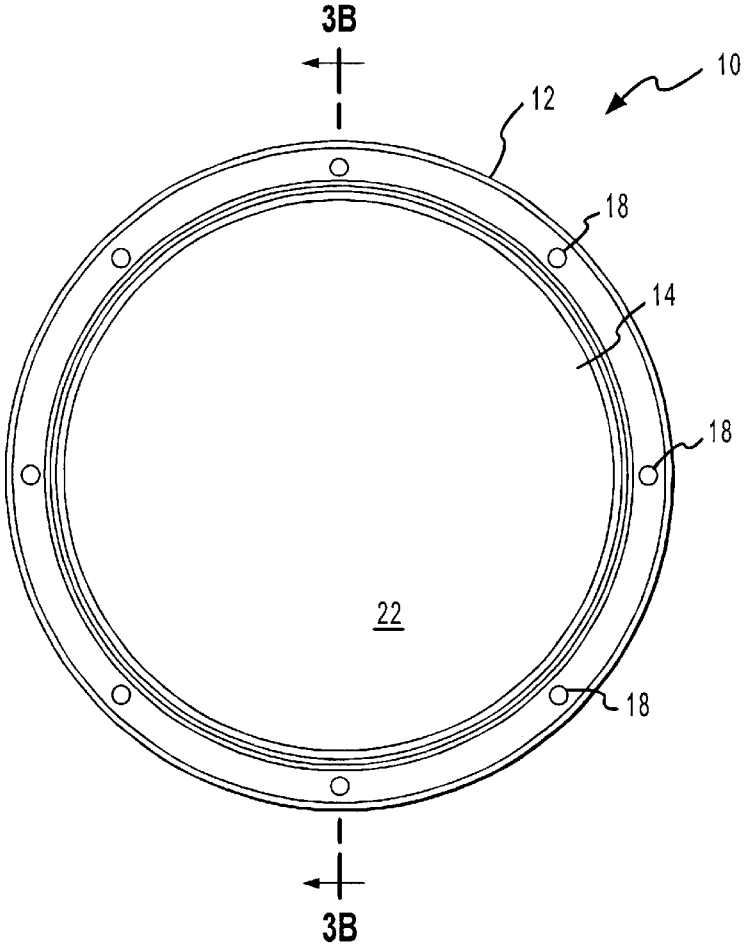
FIG. 3A is a top plan view of a first exemplary embodiment of the present invention.

Turning now to FIG. 3A, there is shown a top plan view of a first exemplary embodiment of the disposable bladder carrier assembly 10 of the present invention. A retaining ring assembly 12 (later described in detail with reference to FIGS. 3B and 3C) is permanently bonded to a bladder 14. The top surface of the retaining ring assembly 12 includes bore holes 18 for removably connecting retaining ring assembly 12 to a CMP apparatus which rotates and moves wafers contained in the retaining ring assembly 12 during chemical mechanical polishing. A top surface 22 of bladder 14 is covered by the CMP apparatus when the retaining ring assembly 12 is connected to the CMP apparatus. The bladder 14 is permanently attached near a bottom surface (not shown) of retaining ring assembly 12 such that a wafer (not shown) will lie adjacent to a bottom surface (not shown) of bladder 14 during processing of the wafer.

Figure 3B:
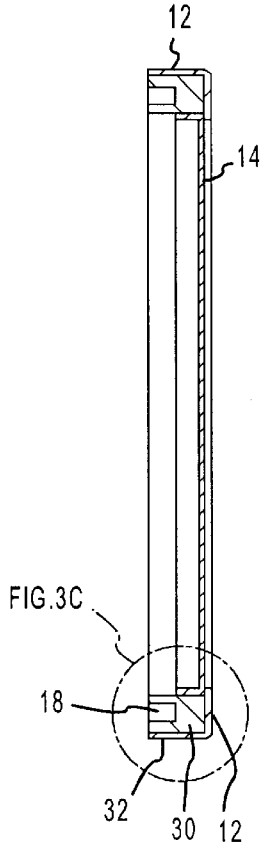
FIG. 3B is a cross-sectional view of the first exemplary embodiment of the present invention taken along line A—A of FIG. 3A.

FIG. 3B is a cross-sectional view taken along line A—A of FIG. 3A. Bladder 14 is permanently bonded to retaining ring 12 by molding with a suspension device so that the bladder 14 can float independently from the retaining ring 12 The permanent bonding of bladder 14 to retaining ring 12 is preferably achieved by molding but may also be achieved with the use of permanent adhesives or the like which are suitable for bonding to rubber. FIG. 3B also shows that retaining ring 12 is comprised of a rigid ring member 30, preferably comprised of steel, having a plurality of bore holes 18 contained therein and a layer of a wear resistant material 32, such as UHMW polyethylene, PEEK polyetherketone, polyphenylene sulfide ,polybutylene terthalate, and homopolymer acetal, for example, which surrounds a substantial portion of steel ring member 30. It is well known that use of inexpensive UHMW polyethylene in carriers could extend the life of the carriers. However, by itself, UHMW polyethylene does not hold shape and dimension well under load. The disposable bladder carrier assembly of the present invention overcomes this limitation by using a steel reinforcement that is locked into the structure with chemical bonding and by casting the structure in a shape that stearically hinders delamination.

Figure 3C:
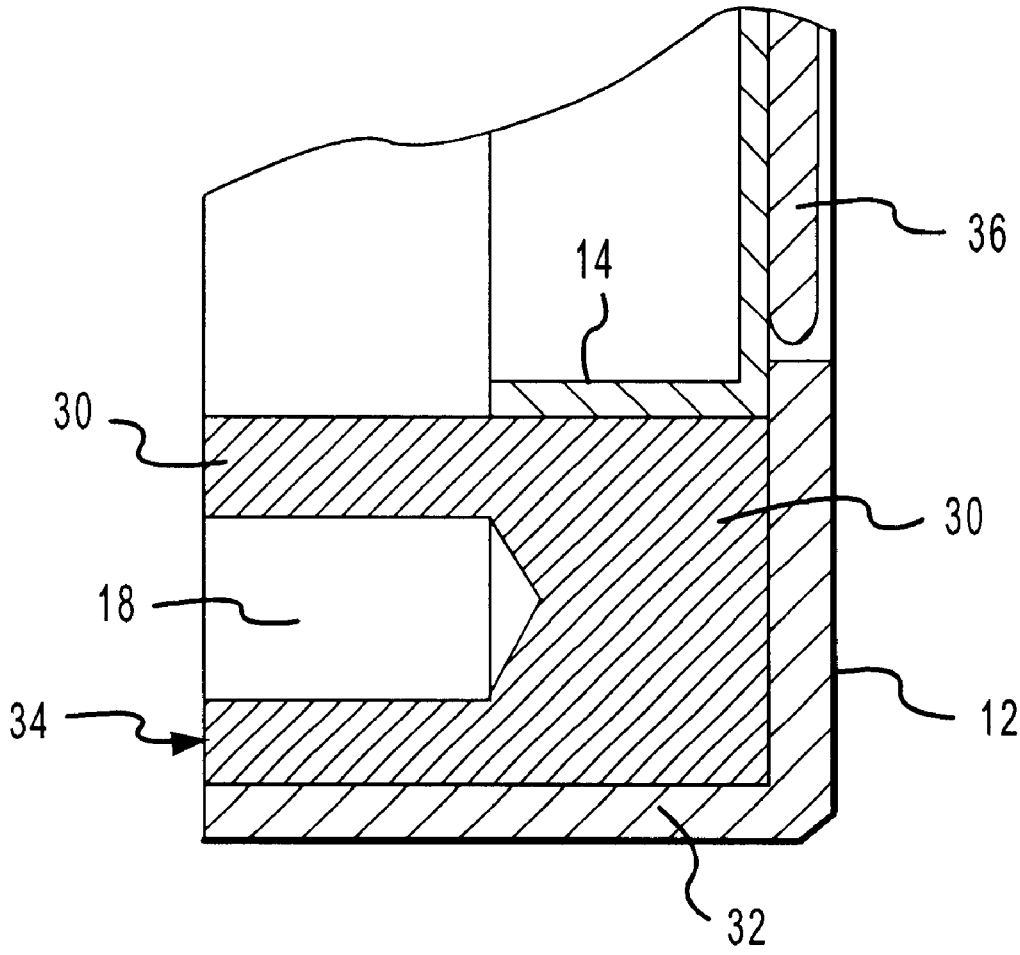
FIG. 3C is an enlarged view of area Z in FIG. 3B.

An enlarged view of area Z shown in FIG. 3B is illustrated in detail in FIG. 3C. A layer of wear resistant material 32, preferably PEEK or UHMW polyethylene, is molded around an adhesive coated rigid ring member 30 having bore holes 18 such that the material layer 32 covers a substantial portion of the outer surface of rigid ring member 30 with the exception of the top surface 34 of rigid ring member 30 which contains the openings for bore holes 18. The material layer 32 forms a continuous layer covering the outer circumference of rigid ring member 30 and the bottom surface of rigid ring member 30. In the embodiment shown in FIG. 3C, bladder 14 is molded to a top surface of material layer 32 where it extends beyond the bottom surface of rigid ring member 30 and a portion of the inner circumference of ring member 30. In use, a bottom surface of wafer 36 lies adjacent bladder 14. Bladder 14 is preferably comprised of rubber which is raw prior to molding the bladder 14 to material layer 32 and ring member 30. Bladder 14 may also be comprised of soft urethanes and the like. Bladder 14 may be molded with a suspension device to allow the bladder 14 to float independently of retaining ring 12.

Figure 4A:
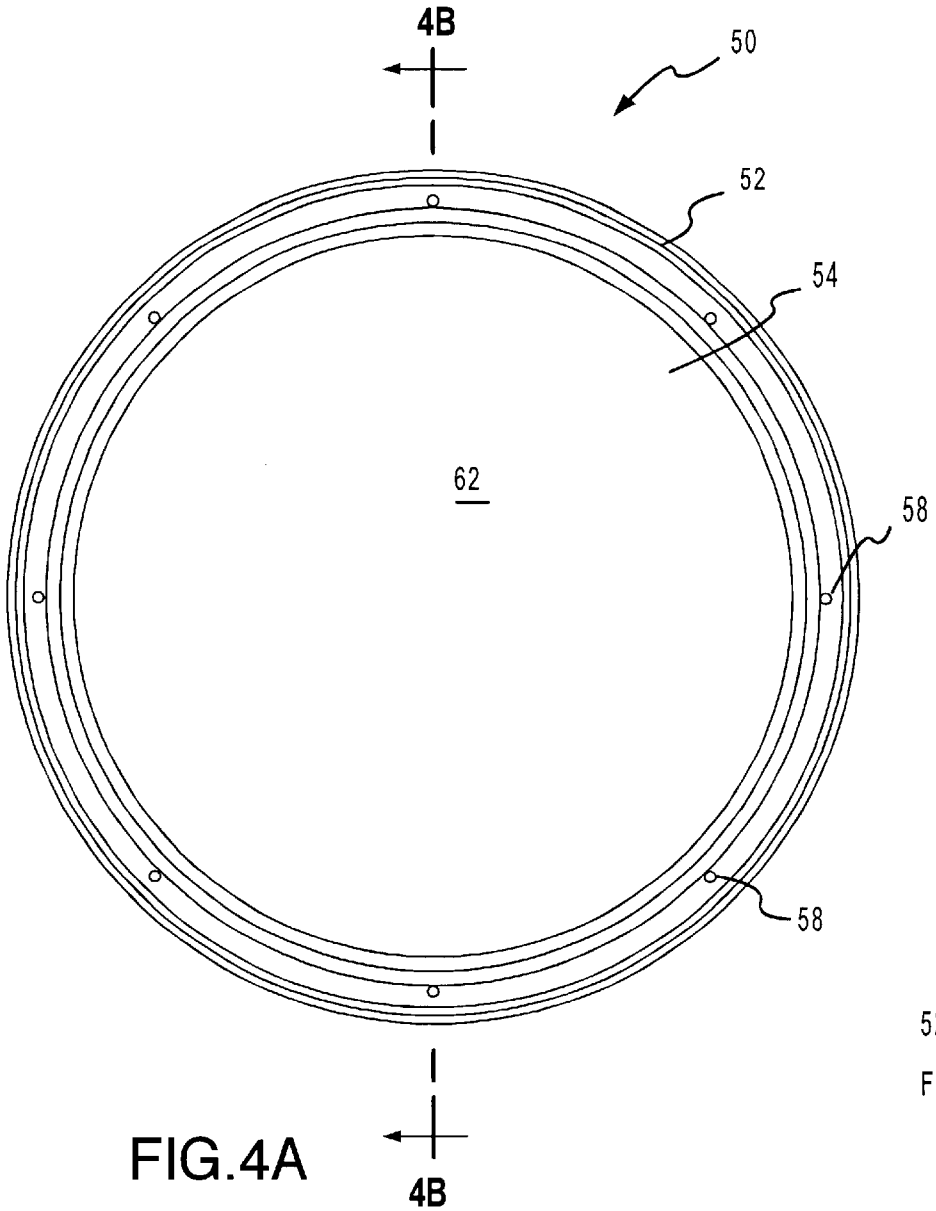
FIG. 4A is a top plan view of a second exemplary embodiment of the present invention showing torroidal bending element.

Turning now to FIG. 4A, there is shown a top plan view of a second exemplary embodiment of the present invention. The disposable bladder carrier assembly 50 includes retaining ring 52 which is permanently bonded, preferably by molding, to bladder 54. A plurality of bore holes 58 are contained within a top surface of retaining ring 52 for connection to a CMP apparatus. Disposable bladder 54 is molded to retaining ring 52 near the bottom of the inner circumference of the retaining ring 52 such that a top surface 62 of bladder 54 is recessed within the inner circumference of retaining ring 52. Bore holes 58 are used to secure the bladder/retaining ring assembly to the CMP apparats used for CMP. During polishing, a wafer will lie adjacent to the bottom surface (not shown) of bladder 54.

Figure 4B:
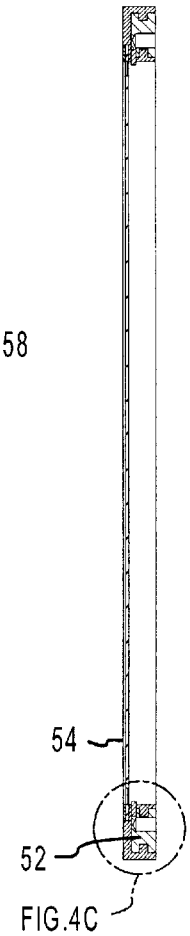
FIG. 4B s a cross-sectional view of the second exemplary embodiment of the present invention taken along line A—A of FIG. 4A.
Figure 4C:
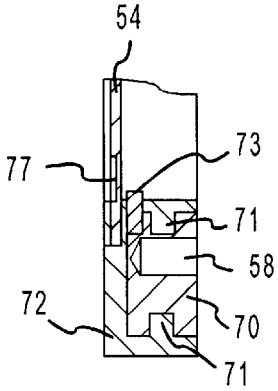
FIG. 4C is an enlarged view of area Z in FIG. 4B.

FIG. 4B shows a cross-sectional view of FIG. 4A taken along line A—A of FIG. 4B. Bladder 54 is shown molded to retaining ring 52. In FIG. 4C, an enlarged drawing of area Z in FIG. 4B shows the connection of bladder 54 to retaining ring 52 in detail. In this embodiment of the present invention, retaining ring 52 comprises a rigid ring member 70 having a channel 71 formed therein about an outside circumference of rigid ring member 70, and a plurality of bore holes 58 formed within a top surface of rigid ring member 70. A wear resistant material layer 72, such as UHMW polyethylene or PEEK, is molded around the bottom and side surfaces of rigid ring member 70. An optional relief space 73 may be formed within either the material layer 72, or both the material layer 72 and rigid ring member 70 during molding of the material layer 72 to the rigid ring member 70. If relief space 73 is formed within a portion of rigid ring member 70, then rigid ring member 70 would be formed to include relief space 73 before molding material layer 72 to rigid ring member 70. Bladder 54 is then molded to material layer 72 of retaining ring 52. In order to achieve this permanent bond, a recess is formed within material layer 72 while molding material layer 72 to rigid ring member 70 and bladder 54 fills this recess when bladder 54 is molded to material layer 72. This embodiment of the present invention may also include a pressure relief space 77 which is formed within bladder 54 when bladder 54 is molded to material layer 72 in order to produce a flat torroidal bending element.

Figure 5A:
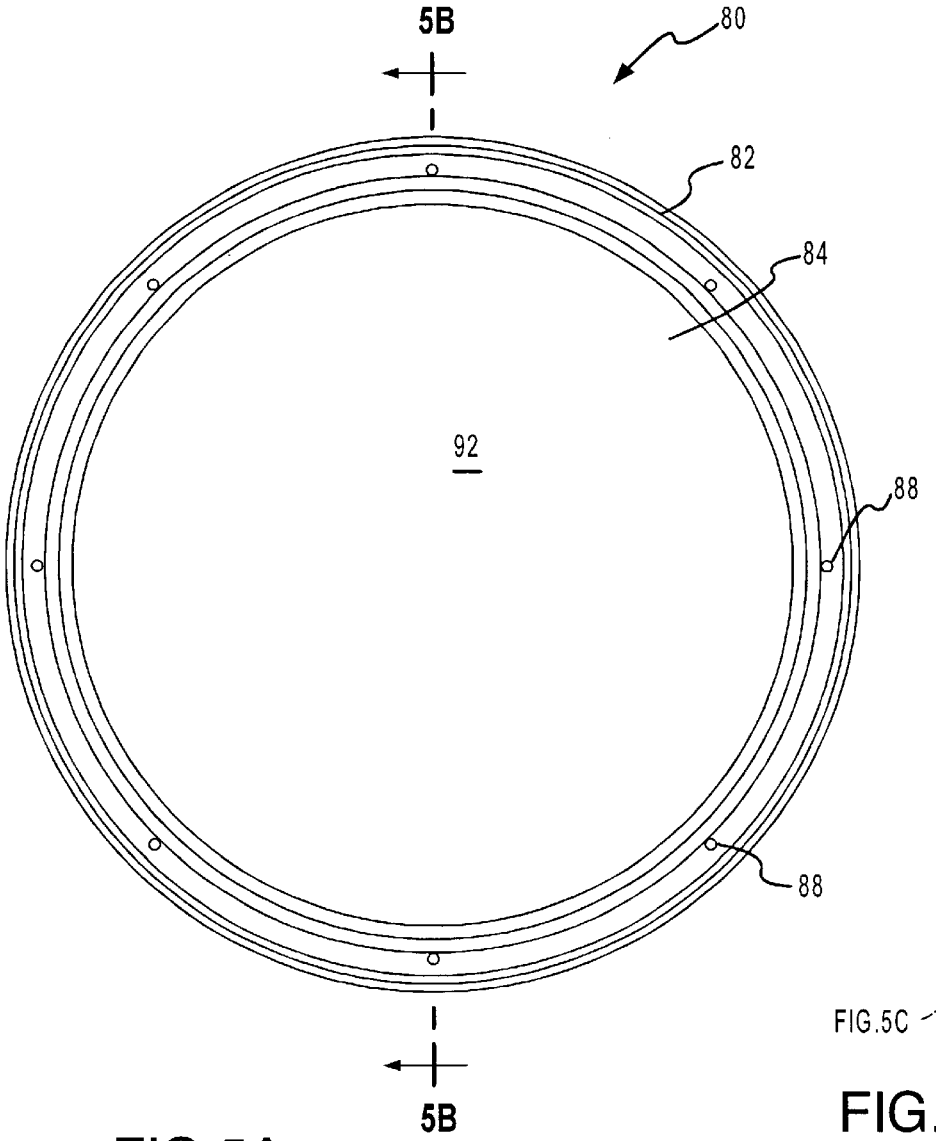
FIG. 5A is a top plan view of a third exemplary embodiment of the present invention showing the wafer loaded into a wafer carrier assembly having a stepped horizontal suspension bending element.
Figure 5B:
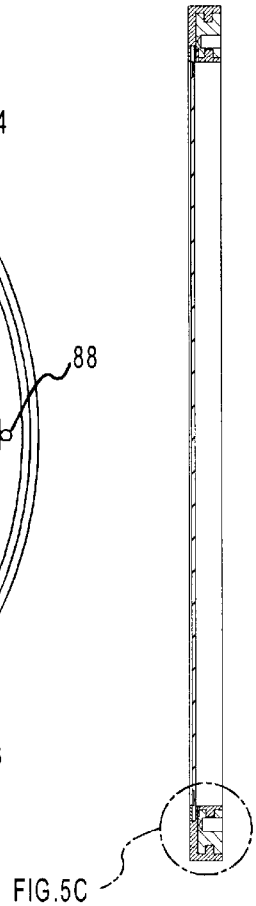
FIG. 5B is a cross-sectional view of the third exemplary embodiment of the present invention ken along line A—A of FIG. 5A.
Figure 5C:
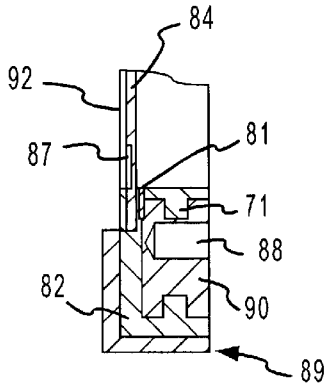
FIG. 5C is a enlarged view of area Z in FIG. 5B.

A third exemplary embodiment 80 of the present invention is shown in FIGS. 5A–5C. FIG. 5A shows retaining ring 82 molded to bladder 84 where a top surface 92 of bladder 84 is recessed within an inner circumference of retaining ring 82 as a result of molding bladder 84 to a bottom inner circumference of retaining ring 82. A top surface of retaining ring 82 has a plurality of bore holes 88 formed therein in order to connect the retaining ring and bladder assembly of the present invention to a CMP apparatus that is used to rotate and move workpieces across a polishing surface during CMP. FIG. 5B shows a cross-sectional view taken along line A—A of FIG. 5B and FIG. 5C shows an enlarged view of area Z identified in FIG. 5B. This third exemplary embodiment 80 of the present invention is identical to the previously described second exemplary embodiment 50 of the present invention with the exception of a machined layer 89 of wear resistant material, such as UHMW polyethylene or PEEK, which is formed over an outer circumference and bottom surface of material layer 82 to produce a stepped horizontal suspension bending element. During polishing, wafer 92 lies adjacent a bottom surface of bladder 84 and machined layer 89 extends beyond the thickness of wafer 92.

Figure 6:
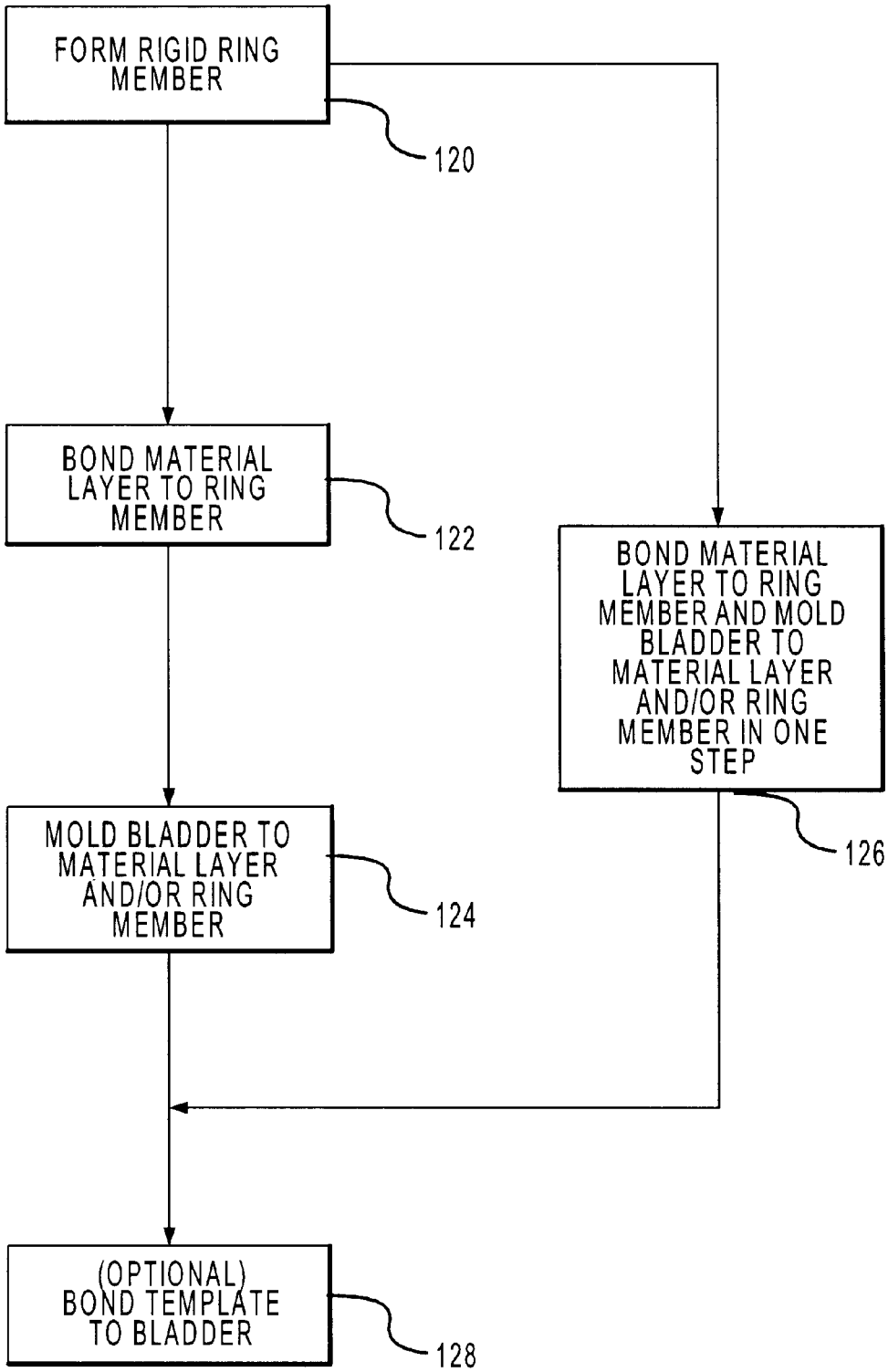
FIG. 6 is a flowchart showing a method for making the bladder carrier assembly of the present invention.

A flow chart showing the method of the present invention for making a bladder and retaining ring assembly for retaining workpieces during CMP is shown in FIG. 6. In step 120, a rigid ring member is formed which is preferably made of steel. An optional channel may be formed within the outer circumference of the ring member. A layer of wear resistant material, such as UHMW polyethylene or PEEK, is then bonded to specific predetermined areas of the outer surface of the rigid ring member in step 122. The metal surface of the ring member which is coated with adhesive and the material layer, which preferably comprises raw rubber, is then molded to the material layer and/or the rigid ring member in step 124 so that a permanent bond is formed between the bladder and the retaining ring which comprises the rigid ring member and material layer. Pressure and heat vulcanize the rubber and cure the adhesive Alternatively, the material layer is molded and bonded in one step as in step 126. During step 126, one or more recesses may be formed within the material layer by the use of spacers during molding to facilitate permanent bonding of the material layer to the rigid ring member and/or to create a pressure relief space. Finally, in step 128, an optional template, preferably comprised of fiberglass, is bonded to the surface of the bladder which lies adjacent a workpiece during polishing.

The present invention comprises a quick disconnect bladder assembly which is suitable for horizontal suspension of wafers. The permanent adhesion and/or compressive joints in the bladder carrier of the present invention improves reliability and reduces cost of ownership as a result of a decrease in required manpower and assembly time. Further, the process for making the disposable bladder assembly of the present invention further reduces cost of ownership because it creates high part identicality from various features such as CNC machining of molds and inserts, rigid positioning of devices during casting, CNC finish machining of the assembly, and minimal utilization of manpower.

The present invention has been described above with reference to exemplary embodiments. These embodiments are illustrative of the invention and its best mode and are not intended to otherwise limit the scope of the present invention in any way. Those skilled in the art having read this disclosure will recognize that changes and modifications may be made to the exemplary embodiments without departing from the scope of the present invention. These and other changes and modifications are intended to be included within the scope of the present invention, as expressed in the following claims.

I claim:

1. A carrier assembly for retaining workpieces during processing comprising:

a rigid ring member, a wear resistant material surrounding the rigid ring member; and a bladder connected to either the wear resistant material, or both the wear resistant material and the rigid ring member.

2. The carrier assembly of claim 1 wherein said rigid ring member is comprised of at least one of a metal, a ceramic, and a rigid polymer composite.

3. The carrier assembly of claim 1 wherein said wear resistant material is comprised of at least one of an ultra high molecular weight polyethylene, PEEK, a polyetherketone, a polyphenylene sulfide, a polybutylene terthalate, and a homopolymer acetal.

4. The carrier assembly of claim 1 wherein said bladder is comprised of at least one of vulcanized or non-vulcanized rubber.

5. The carrier assembly of claim 1 further comprising a cavity within at least one of said wear resistant material and said rigid ring member.

6. The carrier assembly of claim 1 wherein the wear resistant material surrounding the rigid ring member is permanently bonded to the rigid ring member.

7. The carrier assembly of claim 1 wherein the wear resistant material surrounding the rigid ring member is mechanically attached to the rigid ring member.

8. The carrier assembly of claim 1 wherein the wear resistant ring material surrounding the rigid ring member is molded to the rigid ring member.

9. The carrier assembly of claim 1 wherein the bladder is permanently connected to either the wear resistant material, or both the wear resistant material and the rigid ring member.

10. The carrier assembly of claim 1 wherein the bladder is molded to either the wear resistant material, or both the wear resistant material and the rigid ring member.

11. The carrier assembly of claim 1 wherein said steel ring member includes bore holes contained therein.

12. The carrier assembly of claim 1 further comprising a machined layer of wear resistant material positioned over the wear resistant material surrounding the rigid ring member.

13. The carrier assembly of claim 12 wherein said machined layer of wear resistant material is comprised of at least one of an ultra high molecular weight polyethylene , a PEEK, a polyetherketone, a polyphenylene sulfide, a polybutylene terthalate, and a homopolymer acetal.

14. A method for making a carrier assembly for retaining workpieces during processing comprising the steps of:

a) forming a rigid ring member;

b) molding a wear resistant material around the rigid ring member; and c) molding a bladder to at least one of the rigid ring member and the wear resistant material surrounding the rigid ring member.

15. The method of claim 14 wherein the steps of molding a wear resistant material around the rigid ring member and molding a bladder to at least one of the rigid ring member and the wear resistant material surrounding the rigid ring member are performed concurrently.

16. The method of claim 14 wherein said step of forming a rigid ring member further comprises the step of forming a channel within said rigid ring member around an outside circumference of said rigid ring member.

17. The method of claim 14 wherein said step of molding a wear resistant material around the rigid ring member comprises the steps of:

mounting the rigid ring member on a plate; and casting the wear resistant material around the rigid ring member.

18. The method of claim 14 further comprising the step of positioning spacers in predetermined locations prior to the molding steps to create pressure relief spaces.

19. The method of claim 14 further comprising the step of molding a template to a surface of the bladder which lies adjacent to a workpiece to be polished.

20. The method of claim 14 wherein said step of forming a rigid ring member comprises the step of form a rigid ring member from at least one of a metal, a ceramic, and a rigid polymer composite.

21. The method of claim 14 wherein said step of forming a rigid ring member further comprises the step of forming a plurality of bore holes within a top surface of the ring member.

* * * * *